United States Patent [19]

Huempfner

[11] 4,236,261

[45] Dec. 2, 1980

[54] PIVOT TOP FOR STRETCHER OR THE LIKE

[75] Inventor: David F. Huempfner, Two Rivers, Wis.

[73] Assignee: American Hospital Supply Corporation, Evanston, Ill.

[21] Appl. No.: 19,043

[22] Filed: Mar. 9, 1979

[51] Int. Cl.[3] ..... A61G 7/10

[52] U.S. Cl. ..... 5/68; 5/66; 5/79

[58] Field of Search ..... 5/66–68, 5/62, 77, 79, 86

[56] References Cited

U.S. PATENT DOCUMENTS

| | | | |
|---|---|---|---|
| 2,658,210 | 11/1953 | Travis | 5/79 |
| 3,191,196 | 6/1965 | Holm | 5/66 UX |
| 3,611,453 | 10/1971 | Lokken | 5/62 |
| 3,821,821 | 7/1974 | Burst | 5/68 |
| 3,972,081 | 8/1976 | Stern et al. | 5/68 |
| 4,025,972 | 5/1977 | Adams et al. | 5/68 |

*Primary Examiner*—Casmir A. Nunberg
*Attorney, Agent, or Firm*—Larry N. Barger

[57] ABSTRACT

A patient stretcher, bed, or the like having a tiltable mattress support section driven by an actuator having a release clutch mechanism. A sliding joint between the tiltable top section and the actuator permits the clutch to disengage at various angular positions of the tiltable top which are controlled by an adjustable limit stop.

10 Claims, 4 Drawing Figures

PIVOT TOP FOR STRETCHER OR THE LIKE

BACKGROUND

Patient stretchers and hospital beds have frequently included tiltable head, middle, and foot sections. Such types of beds or stretchers are shown in U.S. Pat. Nos. 3,611,453; 3,972,081; and 4,025,972. When such tiltable tops are power driven, there is frequently a problem of holding the tiltable top in a given position for long periods of time. When such power drive is the only support for the tiltable top, excessive strain is put on the linkages and power components.

Some unpowered stretchers and beds have proposed the use of props and limit stops against which the weight of the tiltable top and patient could rest. However, when there are limit stops for different height locations, such limit stops do not work well with power driven pivot tops. Extensive switching and electrical cutoff are necessary to insure the power drive will stop at the particular limit stop without crushing down against the limit stop and possibly bending or distorting certain structural features of the stretcher or bed.

SUMMARY OF THE INVENTION

The present invention overcomes the above problems by providing an adjustable limit stop for a tiltable section of a stretcher or the like. This stop is combined with a sliding joint between a variable length actuator driving the tiltable top section. The sliding joint permits a clutch mechanism connected with the actuator to disengage the tiltable top when it comes in contact with the limit stop and the stop's different settings. No additional power strain on the weight of the top is exerted on the limit stop.

THE DRAWINGS

DETAILED DESCRIPTION

Figure 1:
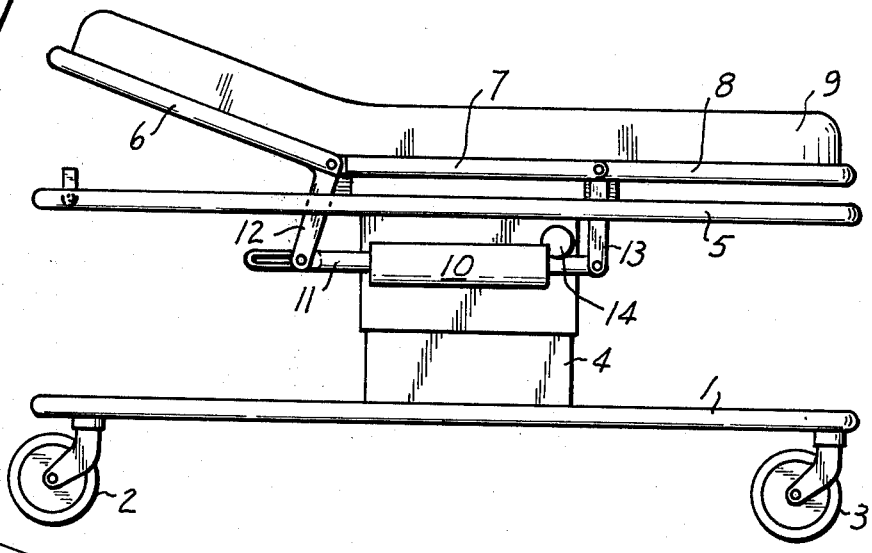
FIG. 1 is a side elevational view of a hospital stretcher.

FIG. 1 shows a stretcher with a running gear 1 having casters such as 2 and 3. A power elevator 4 connects the running gear to an upper section 5. This upper section 5 is in turn secured to a segmented top with pivotally connected head section 6, middle section 7, and foot section 8. These three sections combine to support a mattress 9.

As shown in FIG. 1, the head section 6 of the pivot top is shown in elevated position and is held in such position by an actuator 10 which has an extendable and retractable member 11 that is connected through a linkage 12 to head section 6. An opposite end of the actuator 10 is joined to the stretcher by a support 13. A motor 14 drives an internal screw drive of actuator 10.

Figure 2:
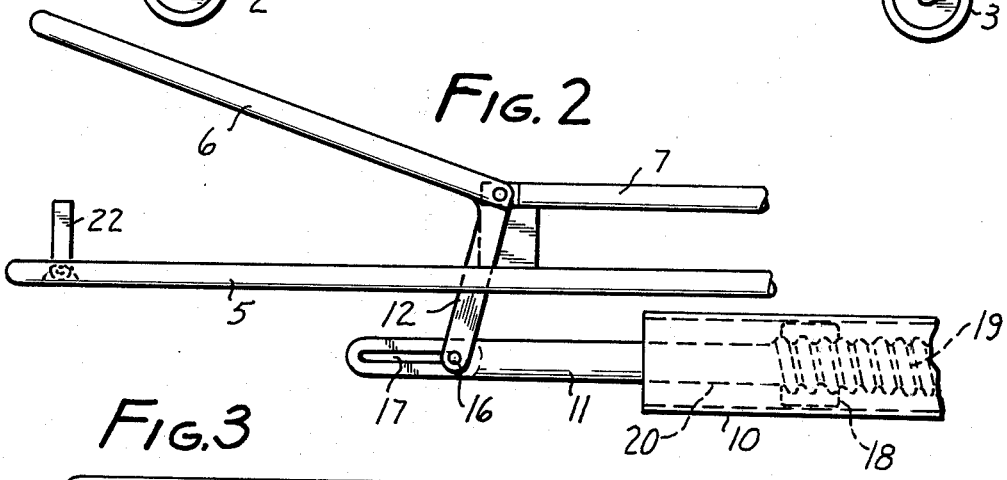
FIG. 2 is an enlarged side elevational view of the tiltable top section of the stretcher and actuator showing the tiltable top in raised position.

In FIG. 2, an enlarged fragmentary view shows the relative position of the actuator and head section 6. Here the weight bearing down on head section 6 causes a pin 16 to bear against a right end of slot 17 of member 11.

The relationship shown in FIG. 2 causes a substantial compression force to be exerted on member 11 tending to drive it further into the main body of actuator 10. This is prevented by a mechanism shown schematically at 18 which engages screw threads 19 of the actuator. It is understood that the details of the threaded mechanism are not shown as they are well-known in commercially available linear actuators. Basically, such actuators include a threaded portion 19 and an unthreaded portion 20. When the actuator reaches a given length, the mechanism 18 will "run out" of threads and begin spinning freely on the unthreaded section 20. Thus, the unthreaded section 20 acts as a release clutch at a given length of the actuator as it is extended or collapsed.

Figure 3:
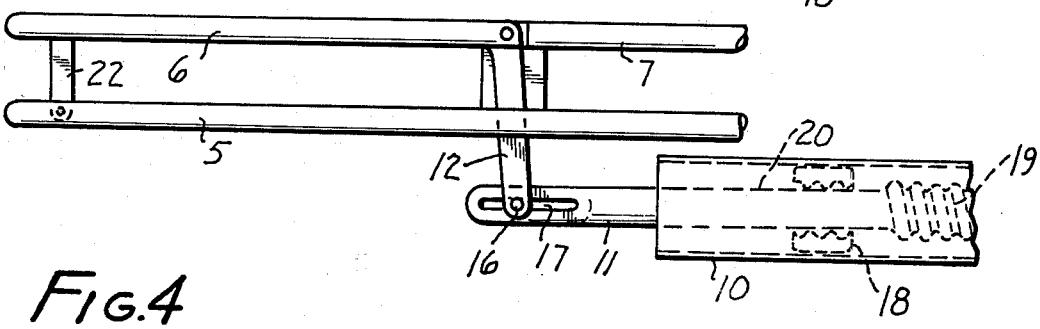
FIG. 3 is a view similar in FIG. 2, but showing the tiltable top in horizontal position.

At a left end of FIG. 2, a pivoted limit stop 22 is shown connected to member 5. In its erected position, limit stop 22 provides the support for the head section 6 as it is lowered by contracting actuator 10. As shown in FIG. 3, the actuator 10 can continue to contract after limit stop 22 is supporting the full weight of head section 6. Slot 17 permits the mechanism 18 to run out onto the unthreaded section 20, thus disengaging threads 19. With this construction, there is no force exerted by actuator 10 tending to cause the head section 6 to crush down against limit stop 22 where it could possibly bend or distort sections of the stretcher or cause injury to a patient, nurse, or physician.

Figure 4:
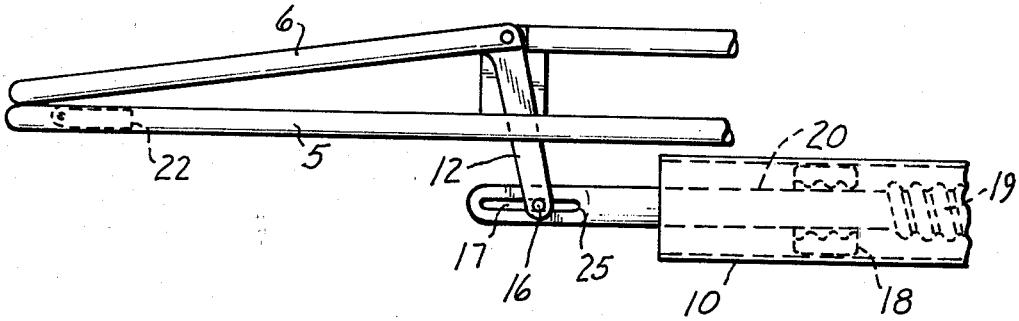
FIG. 4 is a view similar to FIG. 2, but showing the tiltable top in lowered position.

The limit stop 22 in FIG. 4 has been pivoted into a second position as shown in dotted line. This permits the head section 6 to tilt downwardly until it engages member 5. The right end 25 of slot 17 would continue to bear against pin 16 as in FIG. 2, while the head section 6 was being lowered. As in FIG. 3, the actuator 10 can continue to contract until there is no substantial actuator force on link 12. Because of the different angular positions in FIGS. 3 and 4, the pin 16 is more further towards the right end in FIG. 4 than in FIG. 3. Thus, in FIGS. 3 and 4 the member 11 can stop at a common point and relieve coupling pressure for both positions of these two figures.

The above construction shows the head section 6 can be tilted above, coplanar with, or below the middle section 7. The present invention is also adaptable to be used on a foot section 8 of the stretcher. This is also adapted to be used on beds and the like.

In the above description, a specific example has been used to illustrate the invention. However, it is understood by those skilled in the art that certain modifications can be made to this example without departing from the spirit and scope of the invention.

I claim:

1. A stretcher or the like comprising: a top section pivotally connected to a base; stop means on the stretcher to limit the downward travel of the top section at a plurality of positions; a variable length screw actuator on the stretcher joined to the top section for angularly moving the top section; said screw actuator including a nonthreaded run off section which functions as a clutch; and a slide joint on the stretcher for varying the effective length of the actuator, whereby the actuator can disengage coupling pressure with the top section at a plurality of top section positions with a common actuator length.

2. A stretcher or the like as set forth in claim 1, wherein the top is segmented and the first section is tiltable relative to a second section of the top.

3. A stretcher or the like as set forth in claim 2, wherein one position includes both sections lying along a common plane.

4. A stretcher or the like as set forth in claim 2, wherein one position includes the first section angularly disposed relative to the second section.

5. A stretcher or the like as set forth in claim 4, wherein one position includes the first section tilted below the second section.

6. A stretcher or the like as set forth in claim 1, wherein the stop means includes a pivoted member.

7. A stretcher or the like as set forth in claim 1, wherein the screw is driven by a motor.

8. A stretcher or the like as set forth in claim 1, wherein the slip joint is on an extendable and retractable member of the actuator.

9. A stretcher or the like as set forth in claim 1, wherein the slip joint includes a slotted member.

10. A stretcher or the like comprising: a segmented top with an end section pivotally connected to the stretcher for angular tilting both above and below a middle section of the top; a base supportingly connected to the top; an adjustable stop on the stretcher to limit the angular movement of the end section; said stop having at least first and second positions which limit the downward movement of the pivoted end section; a variable length screw actuator on the stretcher joined to the tiltable end section; a nonthreaded run out clutch section on the actuator that disengages at a given length of the actuator; and a slide joint on the stretcher for varying the effective length of the actuator so the clutch can disengage at different settings of the top.

* * * * *